US007976683B2

(12) United States Patent
Scherb

(10) Patent No.: US 7,976,683 B2
(45) Date of Patent: Jul. 12, 2011

(54) MACHINE FOR PRODUCING A FIBROUS WEB

(75) Inventor: Thomas Scherb, Sao Paulo (BR)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 11/962,636

(22) Filed: Dec. 21, 2007

(65) Prior Publication Data

US 2008/0149292 A1 Jun. 26, 2008

(30) Foreign Application Priority Data

Dec. 22, 2006 (DE) ..... 10 2006 062 237

(51) Int. Cl.
*D21F 9/00* (2006.01)
*D21F 1/00* (2006.01)
*D21F 3/00* (2006.01)

(52) U.S. Cl. ..... 162/358.1; 162/206; 162/348; 162/358.3; 162/361; 162/362; 162/280; 162/900; 34/114

(58) Field of Classification Search .... 162/358.1–358.5, 162/348, 359, 361–362, 363–369, 900–903, 162/205–206; 34/114–116, 122–123
See application file for complete search history.

(56) References Cited

U.S. PATENT DOCUMENTS 6,237,644 B1 5/2001 Hay et al.
6,821,391 B2 11/2004 Scherb et al.
6,998,017 B2 * 2/2006 Lindsay et al. ..... 162/109
7,008,506 B2 3/2006 Scherb et al.
7,150,110 B2 * 12/2006 Herman et al. ..... 34/399
7,291,249 B2 * 11/2007 Thoroe-Scherb et al. . 162/358.1
7,294,237 B2 * 11/2007 Herman et al. ..... 162/358.3
7,351,307 B2 * 4/2008 Scherb et al. ..... 162/115
7,387,706 B2 * 6/2008 Herman et al. ..... 162/203
7,428,786 B2 * 9/2008 Herman et al. ..... 34/399
7,476,293 B2 * 1/2009 Herman et al. ..... 162/206
2001/0010260 A1 8/2001 Scherb et al.
2001/0051224 A1 12/2001 Ampulski
2002/0060046 A1 * 5/2002 Scherb et al. ..... 162/358.1
2003/0136018 A1 * 7/2003 Herman et al. ..... 34/114
2004/0020614 A1 * 2/2004 Lindsay et al. ..... 162/109
2004/0237210 A1 * 12/2004 Thoroe-Scherb et al. ... 8/115.51
2005/0126031 A1 * 6/2005 Herman et al. ..... 34/114
2005/0166418 A1 * 8/2005 Lomic et al. ..... 34/117
2005/0167061 A1 * 8/2005 Scherb et al. ..... 162/115
2005/0167062 A1 * 8/2005 Herman et al. ..... 162/115
2005/0167066 A1 8/2005 Herman et al.
2005/0167067 A1 * 8/2005 Crook et al. ..... 162/348
2006/0085998 A1 4/2006 Herman et al.

(Continued)

FOREIGN PATENT DOCUMENTS

EP 1626121 A1 * 2/2006

(Continued)

*Primary Examiner* — José A Fortuna
(74) *Attorney, Agent, or Firm* — Taylor IP

(57) ABSTRACT

A machine for producing a fibrous web, in particular a paper web, paperboard web or tissue web, includes a former on which the fibrous web is formed on a structured belt and is dewatered between said structured belt and a forming belt, and a drying apparatus for the further dewatering of the fibrous web, through which the fibrous web is guided together with the structured belt and in which hot air flows through the permeable structured belt and the fibrous web. The forming fabric is formed by a printed forming fabric or a DSP fabric with zonally different permeability.

17 Claims, 4 Drawing Sheets

U.S. PATENT DOCUMENTS

| | | | | |
|---|---|---|---|---|
| 2006/0085999 | A1* | 4/2006 | Scherb et al. | 34/453 |
| 2006/0225300 | A1* | 10/2006 | Herman et al. | 34/114 |
| 2006/0266487 | A1* | 11/2006 | Scherb et al. | 162/158 |
| 2007/0029061 | A1* | 2/2007 | Scherb et al. | 162/289 |
| 2007/0062657 | A1* | 3/2007 | Scherb et al. | 162/117 |
| 2007/0074835 | A1* | 4/2007 | Scherb et al. | 162/112 |
| 2007/0119558 | A1* | 5/2007 | Scherb et al. | 162/109 |
| 2007/0272386 | A1* | 11/2007 | Scherb et al. | 162/358.4 |
| 2007/0289159 | A1* | 12/2007 | Thoroe-Scherb et al. | 34/306 |
| 2008/0023165 | A1* | 1/2008 | Herman et al. | 162/205 |
| 2008/0073051 | A1* | 3/2008 | Herman et al. | 162/204 |
| 2008/0128104 | A1* | 6/2008 | Scherb et al. | 162/358.2 |
| 2008/0149292 | A1* | 6/2008 | Scherb | 162/309 |
| 2008/0196855 | A1* | 8/2008 | Herman et al. | 162/205 |
| 2008/0210397 | A1* | 9/2008 | Scherb et al. | 162/205 |
| 2008/0251227 | A1* | 10/2008 | Scherb et al. | 162/357 |
| 2008/0257513 | A1* | 10/2008 | Scherb et al. | 162/281 |
| 2008/0257514 | A1* | 10/2008 | Scherb et al. | 162/281 |
| 2009/0065166 | A1* | 3/2009 | Quigley | 162/348 |
| 2009/0065167 | A1* | 3/2009 | Quigley | 162/348 |
| 2009/0165979 | A1* | 7/2009 | Scherb et al. | 162/210 |
| 2009/0165980 | A1* | 7/2009 | Scherb et al. | 162/210 |
| 2009/0183847 | A1* | 7/2009 | Thoroe Scherb et al. | 162/111 |
| 2009/0199986 | A1* | 8/2009 | Biagiotti | 162/117 |
| 2009/0205797 | A1* | 8/2009 | Fernandes et al. | 162/203 |
| 2009/0242158 | A1* | 10/2009 | Scherb et al. | 162/283 |
| 2010/0000695 | A1* | 1/2010 | Quigley | 162/227 |
| 2010/0000696 | A1* | 1/2010 | Quigley | 162/348 |

FOREIGN PATENT DOCUMENTS

| | | | | |
|---|---|---|---|---|
| EP | 1754824 | A1 | * | 2/2007 |
| JP | 2009185442 | A | * | 8/2009 |
| SE | 427053 | | | 2/1983 |
| WO | PCT/GB99/02684 | A1 | | 8/1999 |
| WO | WO0075423 | | | 5/2000 |
| WO | WO 03000989 | A1 | * | 1/2003 |
| WO | WO2005075737 | | | 1/2005 |
| WO | WO 2005075732 | A2 | * | 8/2005 |
| WO | WO 2005075736 | A2 | * | 8/2005 |
| WO | WO 2006045689 | A1 | * | 5/2006 |

* cited by examiner

MACHINE FOR PRODUCING A FIBROUS WEB

BACKGROUND OF THE INVENTION

1. Field of the Invention

This invention relates to a machine for producing a fibrous web, in particular a paper web, paperboard web or tissue web, having a former on which the fibrous web is formed on a structured belt and is dewatered between said structured belt and a forming belt, and having a drying apparatus for the further dewatering of the fibrous web, through which the fibrous web is guided together with the structured belt and in which hot air flows through the permeable structured belt and the fibrous web. Such a machine is described for example in WO 2005/075737 A1.

2. Description of the Related Art

Also known already from WO 00/75423 A1 is a so-called printed forming fabric.

Such a printed forming fabric can be used for example on conventional tissue machines. However, there is no advantage in using a printed forming fabric for an application on such conventional tissue machines because the sheet is pressed 100% and the volume is too small to produce a micro-embossed and macro-embossed sheet on the machine. A suitable processing plant is required for embossing the sheet.

A printed forming fabric can also be used on a TAD machine (TAD=Through Air Drying) where the volume and the sheet absorption capacity are 50 to 100% greater than on conventional machines.

As can be seen from FIG. 1, on such a TAD machine the sheet is formed between two mesh belts 10, 12. FIG. 1 shows in a schematic partial representation the forming region of such a TAD machine. FIG. 2 shows in a schematic representation the TAD machine together with the TAD cylinder 14. As is evident in particular from FIG. 2, on such a TAD machine the fibrous web is dewatered by way of a vacuum directly following the forming region, whereby said dewatering is performed up to a dry content of between 22 and 26%. Not until such a high consistency is reached is the fibrous web then transferred from the one forming mesh or belt 10, which is a smooth belt, to an embossing or structured belt 16, where it is wet-embossed by way of a vacuum box or wet embossing box which sucks the fibers into the depressions of the structured belt 16.

Because a vacuum is applied to an already formed fibrous web with a consistency of over 20%, the fibers are stretched into the depressions, as the result of which the sheet thickness is reduced and only a small part of the fibers remains protected inside the structure of the belt, whereby the fibers in question are those which are not pressed in order to achieve a certain quality (cf. FIGS. 1 and 2). Hence a negative draw between the forming zone and the TAD zone is required on such a TAD machine. Usually, TAD machines are operated in the TAD section at a 20% lower speed in order to brush the fibers into the depressions of the belt. As the result, the entire macro-embossing (markings) from the printed forming fabric are destroyed again by the difference in speed between the forming zone and the TAD zone. On such TAD machines the macro-embossing and micro-embossing take place with the structured belt in the TAD zone instead of in the forming zone.

With such a micro-embossing and macro-embossing on the machine it would be possible to avoid performing such an embossing on the processing plant and hence compressing the sheet and sacrificing quality.

On a TAD machine, quality is thus produced in the TAD zone. The negative draw (~0.8 V) on such a machine serves to produce quality but destroys the embossing effect. Also evident in FIG. 2 are the regions 18 in which the fibrous web, after being transferred from the structured belt 16 to the Yankee cylinder 14, has no contact with the Yankee cylinder.

What is needed in the art is a machine of the type initially referred to which in terms of the quality, volume and water absorption capacity of the produced fibrous web is comparable to a TAD machine.

SUMMARY OF THE INVENTION

The present invention provides that the forming belt is formed by a printed forming fabric or a dimensional structured paper (DSP) fabric with zonally different permeability. The printed forming fabric can be in particular such a printed forming fabric as described in WO 00/75423 A1.

Disclosed according to the invention is therefore a machine for producing a fibrous web, in particular a paper web, paperboard web or tissue web, which includes a former on which the fibrous web is formed on a structured belt and is dewatered between said structured belt and a printed forming fabric or DSP fabric with zonally different permeability, and a drying apparatus for the further dewatering of the fibrous web, through which the fibrous web is then guided together with the structured belt and in which hot air flows through the permeable structured belt and the fibrous web.

Because the produced fibrous web is already wet-structured on the machine, it is no longer necessary for the web to be embossed further upon passing through an expensive processing plant in order to press the micro and macro structures into the fibrous web. In particular this avoids having to press the structure into the already dried fibrous web in a processing plant, which would entail compressing the web, as the result of which the quality, volume and absorption capacity would be reduced.

The printed forming fabric or DSP fabric can be formed by a forming fabric whose surface coming into contact with the fibrous suspension is coated with local lines, dots and/or the like.

In this case the coating material can include for example plastic, rubber and/or the like.

If the coating material includes plastic, then it includes expediently polyethylene, polyamide, polyurethane and/or the like.

As already mentioned, the printed forming fabric used can be constructed as described in WO 00/75423 A1.

Advantageously the printed forming fabric or DSP fabric is provided for a macro-embossing of the fibrous web and the structured belt for a micro-embossing of the fibrous web.

It is an advantage in particular for the fibrous web to be formed with a consistency in the range from around 0.15 to around 0.35% on the structured belt.

On a practical embodiment of the inventive machine, the fibrous web is dewatered further in the drying apparatus between the structured belt and a dewatering belt, whereby the hot air flows through the permeable structured belt, the fibrous web and the dewatering belt in succession.

The drying apparatus includes advantageously an evacuated device such as in particular a suction roller, over which the structured belt, the fibrous web and, if required, the dewatering belt are guided.

The structured belt, the fibrous web and, if required, the dewatering belt can be pressed by way of a permeable press belt against the evacuated device. In this case the hot air can flow first through the permeable press belt and then through the fibrous web.

The drying apparatus includes expediently a hot air hood.

Advantageously this hot air hood lies at least essentially opposite a suction zone of the evacuated device.

It is an advantage in particular for a press nip for the fibrous web, extended in the web running direction, to be formed above the evacuated device.

On a preferred practical embodiment of the inventive machine, the fibrous web is guided together with the structured belt directly after the drying apparatus through a press nip formed between a drying cylinder, in particular a Yankee cylinder, and a press element.

In this case provision can be made for a way to crépe the dry fibrous web in the region of the drying cylinder.

The machine can be used preferably for producing tissue paper.

According to the invention the fibrous web is dewatered between a structured belt or embossing belt and a printed forming fabric or DSP fabric. A further dewatering of the fibrous web takes place expediently between the structured belt and a dewatering belt. The fibrous web is dewatered by way of the dewatering belt which lies opposite the structured belt. The dewatering takes place by way of an air current, in particular a hot air current, and a mechanical pressure field, which can be created by way of a permeable press belt. The air current extends from the permeable press belt to the dewatering belt. The belts, which lie in sandwich fashion one above the other, form a press nip, which is extended in the web running direction, above an evacuated device such as in particular a suction roller. The maximum peak pressure in this case can be 40 times lower than on a conventional press, whereby said extended press nip is charged with air in addition. The fibrous web is carried and/or protected by the structured web and advantageously passed on to a Yankee drying apparatus. The fibrous web is dried further and dry-créped by said drying apparatus which includes for example a Yankee cylinder and a hood.

With such an inventive machine, a structured fibrous web comparable to a TAD product is produced. The same high quality is obtained without an elaborate and expensive TAD machine being required. The cost can be reduced to approximately 40%, whereby less equipment and less work are needed. The machine can be kept simpler in design, whereby its operation and maintenance are also simplified. The entire outlay including energy, sheathing, chemicals etc. is reduced to approximately 35%.

It is also an advantage in particular that on the inventive machine the fibrous web is formed on a structured belt, whereby the forming can begin with a very low consistency of for example between 0.15 and 0.35% and the same structured belt carries the fibers, protected inside its structure, from the headbox to the point of transfer into the Yankee drying unit. In the Yankee drying unit, only those fibers in the knuckle area of the structured belt are pressed. The protected fibers inside the structure of the structured belt remain unpressed in order to obtain the corresponding quality. The depressions of the structured belt are filled with the largest possible amount of fibers, as this represents the mass of unpressed fibers which accounts for the high quality of the end product. The printed forming fabric or DSP fabric is thus a forming belt with which the depressions of the structured belt are sure to remain filled with the largest possible amount of fibers.

Because the produced fibrous web is already structured, it is no longer necessary for the fibrous web to be embossed further upon passing through an expensive processing plant in order to press the micro and macro structures into the web. This avoids having to press the structure into the dry fibrous web in a processing plant which compresses the web and reduces the quality, volume and absorption capacity accordingly.

It has turned out that with the inventive machine, the micro-embossing can take place within the machine without compressing the fibers on the structured or embossing belt and the macro-embossing can take place by using the special printed forming fabric, as described for example in WO 00/75423 A1. In principle it is also possible, as previously explained, to use a DSP fabric with different permeability. Hence instead of a conventional embossing, a shift of fibers takes place according to the invention in the forming zone. The advantage of this is, among other things, that the intimacy between the belts over the evacuated device, in particular a suction roller, is not lost. The evacuated device or suction roller accounts accordingly for a maximum dewatering and a maximum increase in dry content.

In addition, the printed forming fabric or DSP fabric can be exchanged far more quickly than the structured belt, should an operation of the machine with a different macro-embossing (marking) be required.

Hence it is possible with the inventive machine to obtain a high paper quality while avoiding additional elaborate and expensive processing machines for the micro-embossing and macro-embossing.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 1:
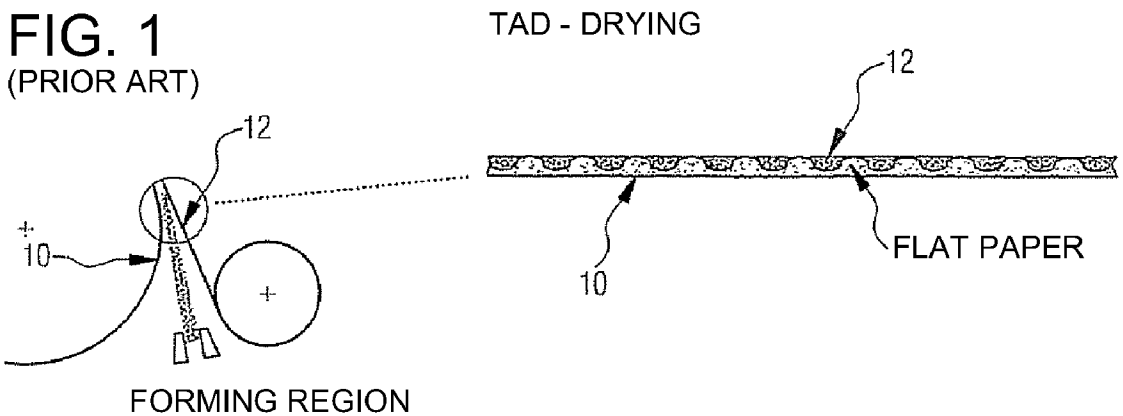
FIG. 1 (PRIOR ART)
FIG. 1 is a schematic partial representation of the forming region of a conventional TAD machine.
Figure 2:
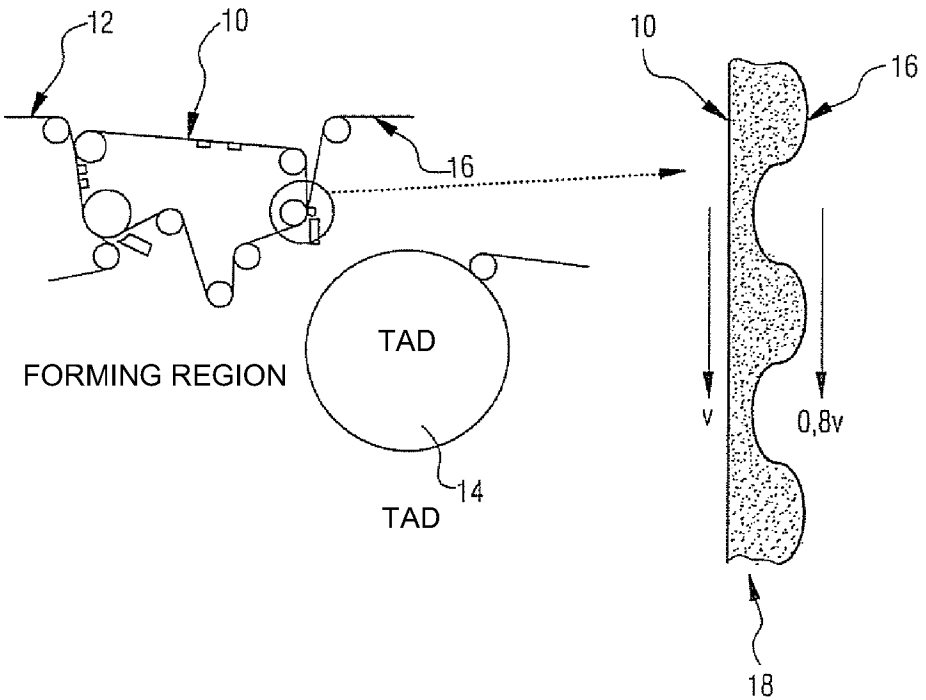
FIG. 2 (PRIOR ART)
FIG. 2 is a schematic representation of a conventional TAD machine including the TAD cylinder.
Figure 3:
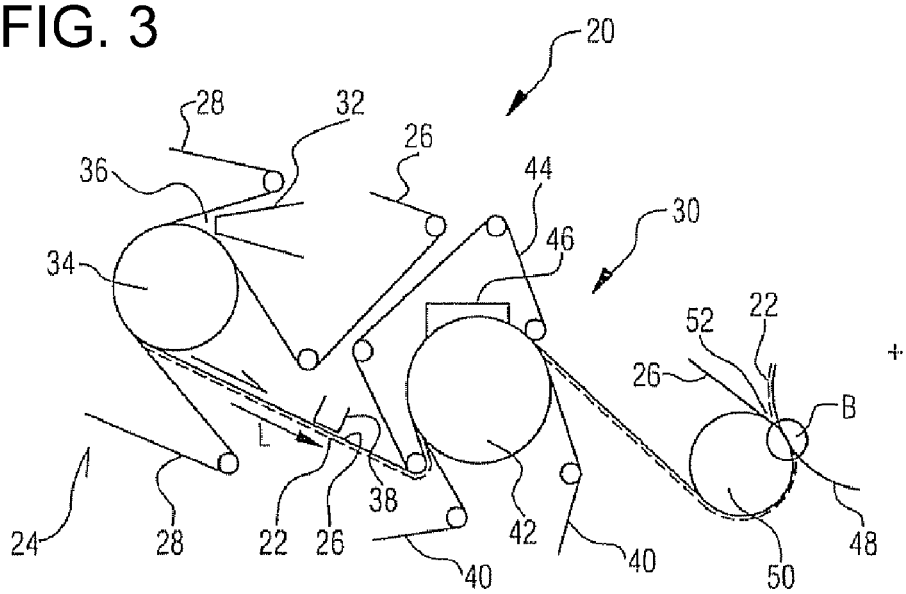
FIG. 3 is a schematic representation of an exemplary embodiment of the inventive machine.

Referring now to the drawings, and more particularly to FIG. 3, there is shown a in a schematic representation an exemplary embodiment of an inventive machine 20 for producing a fibrous web 22, which can be in particular a paper web, paperboard web or tissue web. The machine 20 can be used preferably for producing a tissue web.

The machine 20 includes a former 24, on which the fibrous web 22 is formed on a structured belt 26 and is dewatered between said structured belt and a forming belt which is formed by a printed forming fabric 28 or a DSP fabric with zonally different permeability.

The machine 20 includes in addition a drying apparatus 30 for the further dewatering of the fibrous web 22, through which the fibrous web 22 is guided together with the structured belt 26 and in which hot air flows through the permeable structured belt 26 and the fibrous web 22.

The printed forming fabric 28 or DSP fabric can be formed in particular by a forming fabric whose surface coming into contact with the fibrous suspension is coated with local lines, dots and/or the like. The coating material can be included in particular plastic, rubber and/or the like. For example, the coating material can include for example polyethylene, polyamide, polyurethane and/or the like.

The printed forming fabric 28 used can be for example such a printed forming fabric as is described in WO 00/75423 A1.

The machine 20 includes a headbox 32 and a forming element such as in particular a forming roller 34 over which the structured belt 26 and the printed forming fabric 28 or DSP fabric are guided.

In this case the structured belt 26 or DSP fabric and the printed forming fabric 28 converge to form a fiber intake nip 36, whereby they are guided with the structured belt 26 as the inner belt and with the printed forming fabric 28 or DSP fabric as the outer belt over the forming roller 34. Fibrous suspension is fed by way of the headbox 32 into the fiber intake nip 36.

After the forming roller 34, looking in the web running direction L, it is possible to provide at least one evacuated embossing device 38 which is arranged on the side of the permeable structured belt 26 facing away from the fibrous web 22 and by way of which the fibrous web 22 is sucked into the structure of the structured belt 26.

As can be seen from FIG. 3, directly after the forming roller 34 the fibrous web 22 is brought together with the structured belt 26 to the drying apparatus 30 in which the fibrous web 22 is dewatered further between the structured belt 26 and a dewatering belt 40 (for example a felt). In this drying apparatus 30, drying air, in particular hot air, flows through the permeable structured belt 26, the fibrous web 22 and the dewatering belt 40 in succession.

For this purpose the drying apparatus 30 includes an evacuated device, in particular a suction roller 42, over which the structured belt 26, the fibrous web 22 and the dewatering belt are guided.

In this case the structured belt 26, the fibrous web 22 and the dewatering belt 40 can be pressed by way of a permeable press belt 44 against the suction roller 42. Hence in the case in question, drying air, in particular hot air, flows through the permeable press belt 44, the structured belt 26 and the fibrous web 22 in succession.

In the case in question the drying apparatus 30 includes a hot air hood 46, which can lie at least essentially opposite a suction zone of the suction roller 42.

Hence above the suction roller 42 there is formed a press gap which is extended in the web running direction L and is charged, at least in some regions, simultaneously with hot air.

The fibrous web 22 is guided together with the structured belt 26 directly after the drying apparatus 30 through a press nip 52 formed between a drying cylinder 48, in particular a Yankee cylinder, and a press element 50, in this case for example a press roller. In addition, provision can be made for a way to crépe the dry fibrous web 22 in the region of the drying cylinder or Yankee cylinder.

As is evident from FIG. 3, the fibrous web 22 is carried by way of the structured belt 26 from the former 24 to the drying cylinder or Yankee cylinder 48.

The printed forming fabric 28 or DSP fabric is provided for a macro-embossing of the fibrous web 22 and the structured belt 26 for a micro-embossing of the fibrous web 22.

The fibrous web 22 can be formed in particular with a consistency in a range from around 0.15 to around 0.35% on the structured belt 26.

Figure 4:
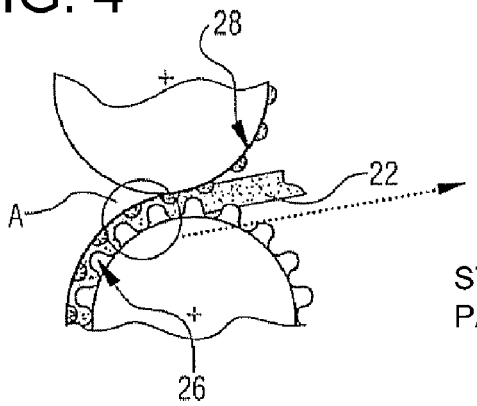
FIG. 4 is a schematic simplified part representation of a forming zone in which a structured belt and a printed forming fabric or a DSP fabric with zonally different permeability are brought together in order to dewater the fibrous web.

FIG. 4 shows in a schematic simplified representation a forming zone in which a structured belt 26 and a printed forming fabric 28 or a DSP fabric with zonally different permeability are brought together in order to dewater the fibrous web 22.

Figure 5:
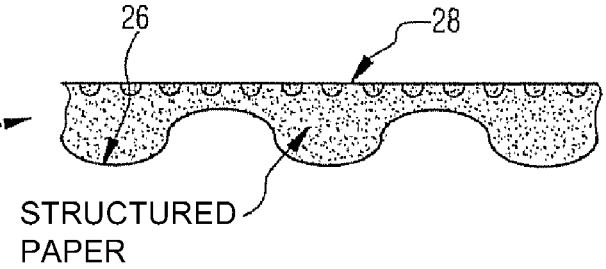
FIG. 5 is an enlarged representation of the area A in FIG. 4 with a printed forming fabric or DSP fabric lying opposite the structured belt.

FIG. 5 shows an enlarged representation of the area A in FIG. 4 with a printed forming fabric 28 or DSP fabric lying opposite the structured belt 26. In this case it is evident that the quality of the paper is created here in the forming zone.

Figure 6:
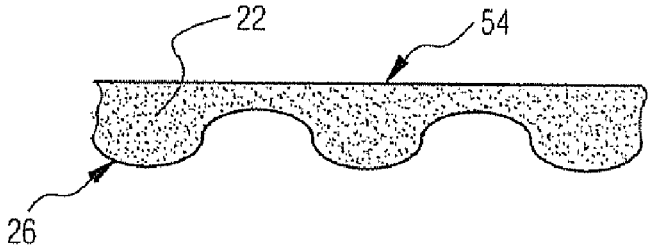
FIG. 6 is an enlarged representation of the area B in FIG. 3 with a structured belt lying opposite the surface of the Yankee cylinder.

FIG. 6 shows an enlarged representation of the area B in FIG. 3 with a structured belt 26 lying opposite the surface 54 of the Yankee cylinder 48. As is evident from FIG. 6, the embossing effect is preserved in the fibrous web 22 which is guided on the same structured belt 26 from the headbox 32 to the Yankee cylinder 48.

Figure 7:
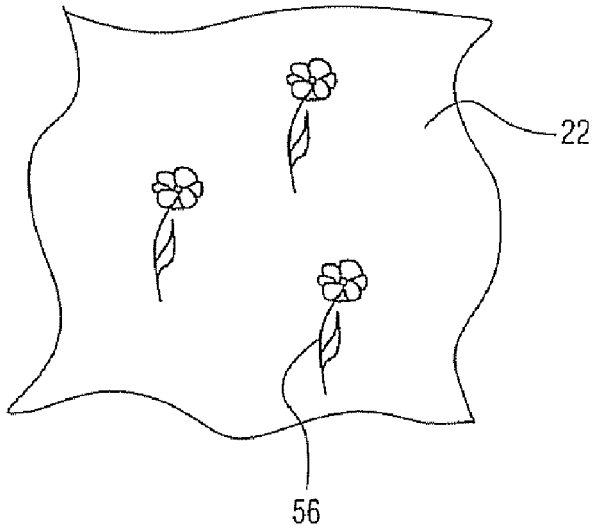
FIG. 7 is a detail of the finished fibrous web, produced by way of the inventive machine, on which patterns caused by the printed forming fabric or DSP fabric can be seen.

FIG. 7 shows a detail of the finished fibrous web 22, produced by way of the inventive machine 20, on which patterns 56 caused by the printed forming fabric 28 or DSP fabric, meaning the respective macro-embossings, can be seen.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE NUMERALS

10 Mesh belt
12 Mesh belt
14 TAD cylinder
16 Structured belt, embossing belt
18 Region
20 Machine
22 Fibrous web
24 Former
26 Structured belt
28 Printed forming fabric, DSP fabric
30 Drying apparatus
32 Headbox
34 Forming element, forming roller
36 Fiber intake nip
38 Evacuated embossing device
40 Dewatering belt
42 Evacuated device, suction roller
44 Permeable press belt
46 Hot air hood
48 Drying cylinder, Yankee cylinder
50 Press element, press roller
52 Press nip
54 Surface
56 Pattern

What is claimed is:

1. A machine for producing a web of fibrous material, said machine comprising:

a structured belt which is permeable;

a former including a forming belt, said former being that on which the web is formed on said structured belt and dewatered between said structured belt and said forming belt, said forming belt including one of a printed forming fabric and a dimensional structured paper fabric with zonally different permeability; and a drying apparatus for further dewatering the web, said drying apparatus being that through which the web is guided together with said structured belt and that in which heated air flows through said structured belt and the web, the machine being configured for producing the web as a tissue paper and not being a Through-Air Drying papermaking machine, said one of said printed forming fabric and said dimensional structured paper fabric macro-embossing the web in an area of the web between a plurality of web pillows provided by said structured belt, said structured belt micro-embossing the web.

2. The machine according to claim 1, wherein the web is formed from a fibrous suspension, said one of said printed forming fabric and said dimensional structured paper fabric being a forming fabric with a surface which comes into contact with said fibrous suspension, said surface being coated with at least one of a plurality of local lines and a plurality of dots.

3. The machine according to claim 2, wherein said surface includes a coating material including at least one of plastic and rubber.

4. The machine according to claim 3, wherein said coating material includes at least one of polyethylene, polyamide, and polyurethane.

5. The machine according to claim 1, wherein said structured belt is that on which the web is formed with a consistency in a range from around 0.15 to around 0.35%.

6. The machine according to claim 1, wherein said drying apparatus includes a dewatering belt, said drying apparatus being that in which the web is dewatered further between said structured belt and said dewatering belt, said drying apparatus being that in which said heated air flows through said structured belt, the web, and said dewatering belt in succession.

7. The machine according to claim 6, wherein said drying apparatus includes an evacuated device over which said structured belt, the web, and said dewatering belt are guided.

8. The machine according to claim 7, wherein said evacuated device is a suction roller.

9. The machine according to claim 7, wherein said drying apparatus includes a permeable press belt, said structured belt, the web, and said dewatering belt being pressed by said permeable press belt against said evacuated device.

10. The machine according to claim 9, wherein said heated air flows first through said permeable press belt and then through the web.

11. The machine according to claim 7, wherein said drying apparatus includes a hot air hood.

12. The machine according to claim 11, wherein said evacuated device defines a suction zone, said hot air hood lies at least essentially opposite said suction zone of said evacuated device.

13. The machine according to claim 7, wherein above said evacuated device is formed a press nip for the web, extended in a web running direction.

14. The machine according to claim 1, further including a drying cylinder and a press element, the web being guided together with said structured belt directly after said drying apparatus through a press nip formed between said drying cylinder and said press element.

15. The machine according to claim 14, wherein said drying cylinder is a Yankee cylinder.

16. The machine according to claim 14, wherein the machine is configured for crêping the web when the web is dry and at least near said drying cylinder.

17. The machine according to claim 14, wherein said structured belt carries the web from said former to said drying cylinder.

* * * * *